US005487600A

United States Patent [19]

Griffin

[11] Patent Number: 5,487,600

[45] Date of Patent: Jan. 30, 1996

[54] CONTAINER FOR EARRINGS AND SMALL JEWELRY

[76] Inventor: Brenda G. Griffin, P.O. Box 288, Sagle, Iowa 83860

[21] Appl. No.: 370,099

[22] Filed: Jan. 9, 1995

[51] Int. Cl.[6] ..... A47F 3/10

[52] U.S. Cl. ..... 312/135; 312/305; 211/129

[58] Field of Search ..... 312/284, 138.1, 312/135, 125, 305, 293.3; 211/13, 126, 129, 131; 206/6.1

[56] References Cited

U.S. PATENT DOCUMENTS

| | | | |
|---|---|---|---|
| D. 124,670 | 1/1941 | Ruderman . | |
| D. 195,072 | 4/1963 | Kolarik . | |
| D. 245,650 | 9/1977 | Mueller et al. | D6/4 |
| D. 300,266 | 3/1989 | Lane | D28/11 |
| D. 315,228 | 3/1991 | Stringham | D28/73 |
| D. 317,838 | 7/1991 | Millet et al. | D6/472 |
| D. 325,483 | 4/1992 | Muhlack | D6/472 |
| D. 337,671 | 7/1993 | Rushing | D6/455 |
| 2,157,400 | 5/1939 | Cooper | 211/129 X |
| 3,197,096 | 7/1965 | Marcocchio | 312/284 X |
| 3,452,880 | 7/1969 | Kovacik et al. | 211/129 X |
| 3,788,489 | 1/1974 | Levinthal | 211/163 |
| 4,141,453 | 2/1979 | Hanan | 211/13 X |
| 4,390,099 | 6/1983 | Trautlein et al. . | |
| 4,549,664 | 10/1985 | Gowan et al. | 211/131 |
| 4,614,272 | 9/1986 | Shelton et al. . | |
| 4,632,474 | 12/1986 | Ingersoll | 312/305 |

*Primary Examiner*—Peter M. Cuomo
*Assistant Examiner*—James O. Hansen
*Attorney, Agent, or Firm*—Keith S. Bergman

[57] ABSTRACT

A covered container for earrings and small jewelry provides an annular dish-like base rotatably supporting a compound upstanding medial column. The medial column is formed by one or more elements having a tray-like upper portion with an upturned peripheral rim, both the rim and peripheral tray portion defining slots to support various types of earrings. Each medial column below the uppermost element defines an upstanding fastening structure to pivotally mount another column element thereabove. A dome-like cover is releasably supported on the periphery of the base to enclose the medial portion of the base and the medial column structure.

3 Claims, 2 Drawing Sheets

CONTAINER FOR EARRINGS AND SMALL JEWELRY

BACKGROUND OF INVENTION

RELATED APPLICATIONS

There are no applications related hereto heretofore filed in this or any foreign country.

FIELD OF INVENTION

This invention relates generally to covered jewelry containers, and more particularly to such a container having a dish-like base supporting a compound rotatable medial columnar structure extending above the base and defining one or more trays having slotted peripheral structure to support earrings.

BACKGROUND AND DESCRIPTION OF PRIOR ART

The popularity of small items of jewelry such as earrings and rings for personal adornment, especially of females, has been ongoing since the creation of such devices. This jewelry by reason of its size and often substantial economic value has presented problems for containment and storage. Responsively many storage and containment devices have heretofore become known. Those known devices, however, have not fully resolved all problems associated with their use and the present device has been developed to resolve continuing problems associated with such prior devices.

Earrings by the nature of their structure have provided storage problems because the structure commonly provides an object that can easily become entangled with other jewelry, and especially with other earrings. This entanglement makes it difficult to remove individual items of jewelry from an entangled mass, may cause damage to the jewelry during handling and often makes it difficult to find both members of jewelry commonly used in pairs, such as earrings Additionally, the aesthetic desires of most earring users is such as to require a neat, well ordered array of small jewelry to satisfy the user's psyche and provide ego satisfying display for peers.

Known jewelry storage cases have often not addressed this problem and those that have addressed it have not satisfactorily resolved it. Some containers have provided septum-type structures to define a plurality of isolated containment spaces, but these containers in general have been large and cumbersome in proportion to the amount of jewelry stored and if more than one piece of jewelry is stored in any single containment space the same problems persist. Some devices generally have not allowed viewing of all or substantially all of a piece of jewelry from a single viewpoint and normally have not provided any method of moving the containment spaces to allow this function. Another type of display, especially for use with earrings, has provided some type of relatively thin rigid support defining orifices in which earrings may be fastened for storage. These structures normally are designed for use with earrings having a post and removable clasp and usually require the removal of the clasp for placement of the earring and then either require the clasp to be separately stored or replaced on the earring post after positioning in the storage element.

In contradistinction, the instant invention is particularly adapted for the storage of all common types of earrings without removal of clasp structures by providing tray-like elements having an upturned periphery defining a plurality of radially extending slots in the upper portion of the upturned periphery with radially extending counterpart slots spacedly adjacent thereto defined in the tray floor. This structure accepts post-type earrings with the clasp in place and the so-called "fishhook" or clamp-type earrings and positions any of them with the earring ornament extending upwardly or radially outwardly from about the periphery of the tray so that the earring may be readily viewed for inspection.

Most jewelry display cases are supported on a shelf or similar horizontal support that allows viewing from only one side, but it is convenient and desirable that some means be provided to allow viewing of an ornamental earring portion distant from an observer. The instant device accomplishes this by providing a removable dome-type cover for the entire storage structure and a compound medial columnar structure formed by a plurality of vertically stacked tray elements, each having a depending tubular pedestal to rotatably interfit with the base of the device or an immediately lower tray. This compound medial columnar structure allows any tray element to be rotated relative to the base or to any other tray and allows all intermediate trays to be of the same design and configuration for ease of manufacture, while yet providing a structure that may be completely covered as desired.

The structure of the entire container is designed and configured to adapt it for formation from molded polymeric materials with various angulated elements that provide necessary strength and rigidity while requiring a minimal. volume of polymeric material for formation. The dome cover defines an inset element that serves both as surface ornamentation and as a beam-like structure to allow formation from relatively thin material while yet providing appropriate rigidity and strength which may not otherwise exist in a member of similar thickness that did not have this structure.

My invention resides not in anyone of these features individually, but rather in the synergistic combination of all of its structures that necessarily give rise to the functions flowing therefrom as herein specified and claimed.

SUMMARY OF INVENTION

My invention generally provides a base having a depending peripheral skirt for support on an underlying surface and defining a tray-like medial portion having an upstanding peripheral edge to support the base of a cylindrical domed cover. The medial portion of the base defines an upstanding fastening column to rotatably support one or more tray elements forming a medial columnar structure thereabove. Each tray structure provides a depending tubular column defining a channel for rotatable support on the fastening column of the base or an intermediate tray and has fastening means to aid positional maintenance thereon. Each tray provides a medial storage cavity communicating with a horizontally oriented annular outer shelf having an upturned peripheral rim. The peripheral rim defines a plurality of circumferentially spaced vertical slots extending to a point spacedly adjacent the outer shelf and the outer shelf defines a plurality of radially extending slots associated with each rim slot, but extending only spacedly adjacent thereto to provide cooperating slot pairs for positional maintenance of earrings therein. Each intermediate tray below the top tray provide an upstanding fastening column to rotatably receive the depending column of the tray thereabove. The top tray does not provide an upstanding support column.

A cylindrical cover having a domed upper portion defines a chamber to fit over the upstanding trays when the cover is supported on the base and about the upstanding peripheral portion of the medial cavity. The cover defines an inset panel that provides additional strength and rigidity by reason of the beam effect of its peripheral portion.

In providing such a container, it is:

A principal object to provide a covered container having a base rotatably supporting a plurality of upstanding, vertically spaced trays having a medial storage area supporting a peripherally extending annular shelf having an upturned peripheral rim with vertical slots defined in the upstanding rim to extend spacedly adjacent to radially extending slots defined in the horizontal annular shelf to form cooperating slot pairs to receive earrings for positional maintenance.

A further object is to provide such a container that has tray elements with depending tubular columns to rotatably fit upon a fastening column extending upwardly from the medial portion of the base or a lower tray structure so that all trays may be rotated relative to each other and relative to the base.

A further object is to provide a dome-type top cover that is supported on the base and defines an indented panel having a peripheral structure that acts as a beam to provide additional strength and rigidity for the cover.

A still further object is to provide such an article that is of new and novel design, of rugged and durable nature, of simple and economic manufacture and one that is otherwise well suited for the uses and purposes for which it is intended.

Other and further objects of my invention will appear from the following specification and accompanying drawings which form a part hereof. In carrying out the objects of my invention, however, it is to be understood that its features are susceptible to change in design and structural arrangement, with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
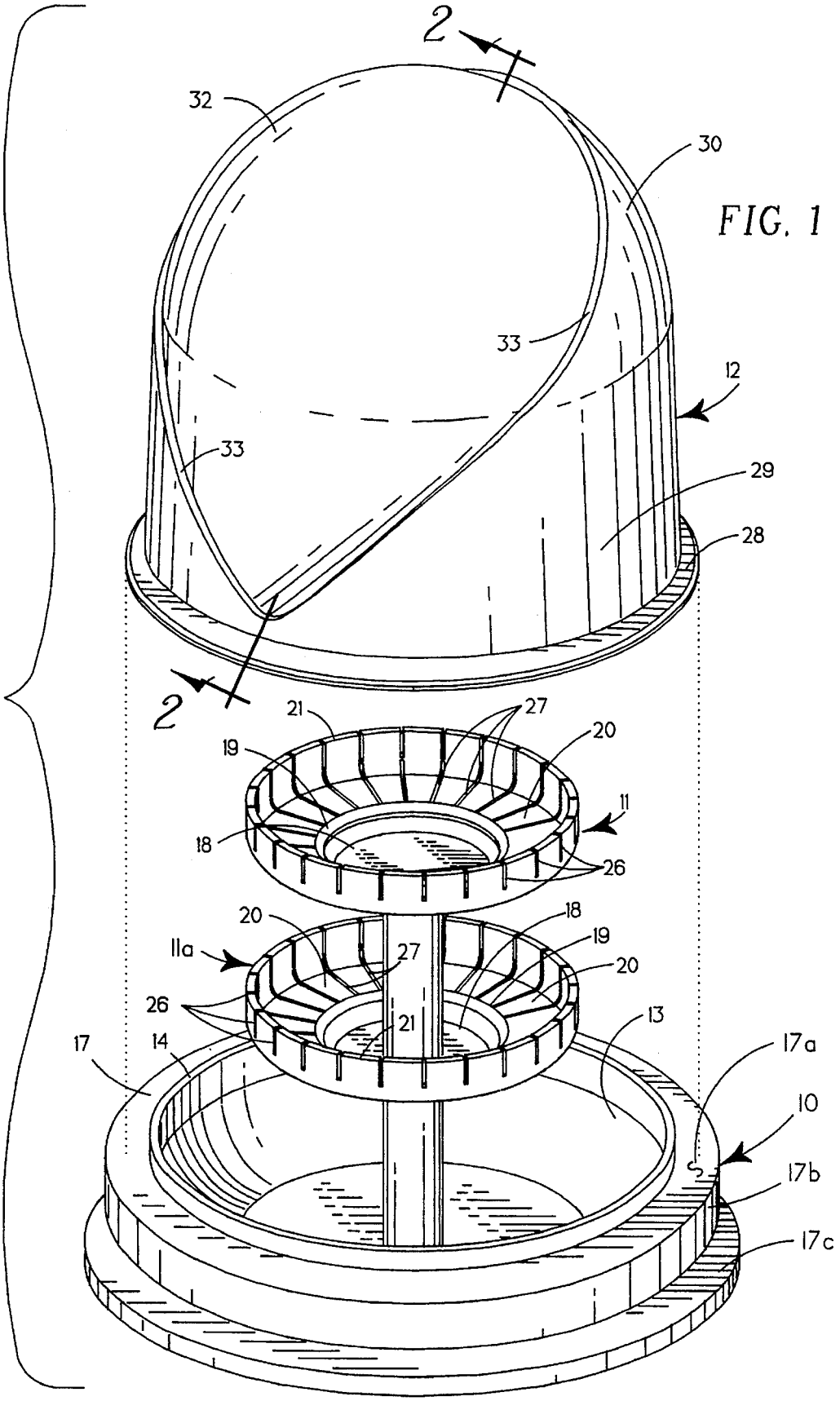
FIG. 1 is an isometric view of my container with the cover removed to show its various parts, their configuration and relationship.

My invention generally provides base 10 defining a storage cavity and rotatably supporting plural storage trays 11 extending in spaced relationship thereabove and carried within the chamber defined by cover 12 when supported on the base.

Base 10 is a cylindrical structure formed by various surfaces of revolution. The base defines a medial container dish 13 having vertical peripheral rim 14, the upper portion of which positionally maintains the base of cover 12 thereon. The medial portion of the upper surface of container dish 13 supports upstanding fastening column 15 defining annular fastening groove 16 in its upper portion to provide a fastening structure for positional maintenance of a storage tray. The upper external surface of container dish 13 supports peripheral skirt 17 extending radially outward and downwardly therefrom to provide support on an underlying supportative surface. Peripheral skirt 17 defines horizontal upper portion **17*a* outwardly adjacent container dish rim 14 to support the base of cover 12. Vertical portion 17*b* extends downwardly therefrom and lower rim portion 17*c*** supports the base on a generally horizontal planar surface.

Medial storage tray **11*a* provides tray dish 18 having upstanding peripheral rim 19 which structurally communicates with somewhat perpendicular annular support shelf 20 extending radially outwardly therefrom. The annular support shelf 20 structurally carries vertically upstanding peripheral rim 21** extending thereabove in cylindrical fashion.

The medial portion of tray dish 18 on its upper surface carries vertically upstanding fastening column 22 having fastening groove 23 in its upper portion in substantially the same configuration as those comparable elements of the fastening column 15 of the container dish. The lower surface of the tray dish structurally interconnects depending tubular support column 24 defining internal channel 25 incrementally larger that the external diameter of an upstanding fastening columns 15, 22 so that the support column may be rotatably carried by a fastening column.

The lower portion of the internal surface of channel 25 defines one or more protuberances 46 to fit upon some deformation within fastening grooves 16, 23 defined by the fastening columns to aid in positionally maintaining the support columns thereon.

Figure 4:
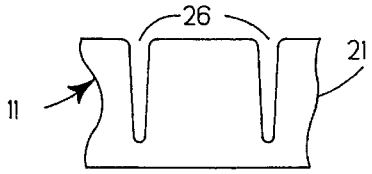
FIG. 4 is a partial enlarged isometric view of the slots defined in the upstanding vertical peripheral rim of one of the storage trays.

The vertical rim 21 of the annular support shelf 20 defines a plurality of circumferentially spaced, vertically oriented channels 26 extending from the upper edge of that rim to a point spacedly adjacent the upper surface of the annular support shelf. These channels 26 have a width appropriate to accommodate the posts or wires of earring structures, commonly approximating 0.03 to 0.05 inches in the narrowest portion. They may have a somewhat angulated shape as shown in FIG. 4 to aid insertion of earrings components therein and to aid formation by molding.

The annular support shelf 20 defines a plurality of radial channels 27 extending from the peripheral rim 19 of the associated tray dish to a point spacedly adjacent the radially inner surface of vertical rim 21. The channels 27 are so arrayed and positioned that one channel extends in radial alignment with each channel 26 defined in vertical rim 2l so that adjacent pairs of channels 26, 27 may cooperate to hold portions of an earring in each channel. The two channels do not communicate with each other as portion 46 of the tray structure extends therebetween because a substantial portion of the channel function would be lost were the adjacent associated channels to communicate with each other.

Cover 12 provides a peripherally defined, shell-like structure formed by the structural communication of lower rim 28, medial cylindrical body portion 29 and hemispherical top portion 30 to define medial chamber 31. Lower rim 28 extends radially outwardly from the outer surface of cylindrical body portion 29 to define an annular lower surface that is supported on horizontal portion **17*a* of the peripheral skirt 17 of the base. The internal diameter of the cylindrical body portion 29 of the top is incrementally greater than the external diameter of the upper rim 14** of the base so that the cover may be placed upon the base and be there supported and positionally maintained.

The medial body portion 29 and hemispherical top portion 30 of the cover define an indented panel 32 having a peripheral rim 33 comprising a transition zone from the primary portion of the cover. The indented panel 32 has an outer surface that is configured to be substantially coincident with the inner surface of the remaining primary portion of the cover so as to maintain aesthetic and structural similarity with the main portion of the cover. The peripheral transition area 33 is somewhat thicker than the cover portions on either side thereof so that this peripheral transition area tends to form a somewhat stronger, more rigid beam-like structure which provides additional rigidity and strength to the entire cover. The shape of the indented panel is not critical, but the general inverted tear drop shape illustrated is preferred as it maintains the aesthetics of design while yet providing its structural benefits in areas where the beneficial function is maximized.

Though the foregoing description of my jewelry container is of a structure that generally is a surface of revolution with circular horizontal cross-sections, this shape is not essential and other cylindrical shapes are within the ambit and scope of my invention so long as the various components have the structural features and relationships specified for them. The size of the container is not critical, though preferably the cover body has a diameter of about nine to ten inches and the other components are proportioned as illustrated in the drawings. In the instance illustrated, only one medial tray is shown, but more such structures may be added in the same fashion as described, so long as the size of the cover is appropriately expanded to allow its medial chamber 31 to contain the assembled tray structure.

Having described my invention, its use may be understood.

Firstly, a container is formed according to the foregoing specification and placed on some flat, substantially horizontal surface for support. To use the container, cover 12 is removed and temporarily stored to expose the base and storage trays that may be fitted with various items of jewelry. The container dish of the base commonly will be used for small items of jewelry other than earrings. These items are placed in the tray in the ordinary fashion for storage as desired, either in spaced adjacency or stacked array. Other small items of jewelry may be similarly placed in the tray dishes.

Figure 3A:
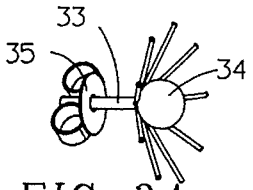
FIGS. 3A, 3B, 3C, 3D and 3E are illustrations of various common types of earrings which may be supported for positional maintenance in my container.
Figure 3B:
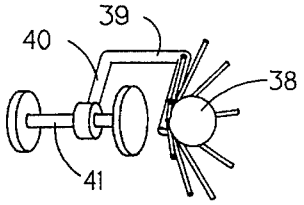
Figure 3C:
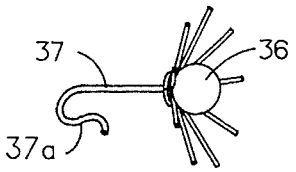

The primary types of earring structures are illustrated in FIGS. 3A–3E, classified according to the method by which they attach to a wearer's ear. The earrings of FIGS. 3A and 3C are for use with so called "pierced ears" having a hole through the lobe, while the earring structures of FIGS. 3B, 3D and 3E require no hole to be defined in a supporting ear lobe.

The clasp-type earring of FIG. 3A provides earring post 33 carrying an ornament 34 at one end and having a releasable clasp 35 that fits over the earring post to fasten on the inner side of an ear lobe with the ornament on the outer side. The so-called "fishhook" or wire-loop type of earring shown in FIG. 3C provides ornament 36 carried at one end of fastening wire 37 formed in a complex loop 37A somewhat in the shape of a fishhook so that this loop structure may be threaded through a hole defined in an ear lobe to allow the ornament structure to depend on the outside of the ear lobe.

Figure 3D:
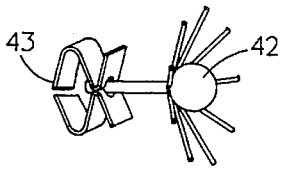

The earring of FIG. 3B provides ornament 38 carried by one leg of a U-shaped support 39. The opposite leg 40 of that support carries threaded shaft 41 so that the device may be placed about the periphery of an ear lobe with the ornament on the outside and the screw shaft on the inside to positionally maintain the earring on the lobe. The earring structure of FIG. 3D provides ornament 42 supported on clasp 43 which may be opened to clamp about an ear lobe for fastening. The earring of FIG. 3E provides ornament 44 carried on base 45 which has adhesive on its surface distal from the ornament to adhere to the outer surface of an ear lobe.

All of these types of earrings are storable in my container structure. The clasp earring of FIG. 3A preferably is stored with the clasp in place by placing the earring post in one of the channels 21 defined in the peripheral rim 21 of the annular support shelf 20 with the ornament facing radially outwardly. The screw-clamp earring of FIG. 3B normally is stored in the same fashion with either the back of U-shaped element 39 or the screw shaft 41 positioned in one of the vertical channels 26 defined in a tray rim 21. The earring of FIG. 3C normally will be stored by placing the hook element 37 in one set of adjacent slots 26, 27 and about the element 46 extending between associated channels.

Figure 3E:
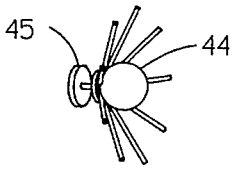
Figure 2:
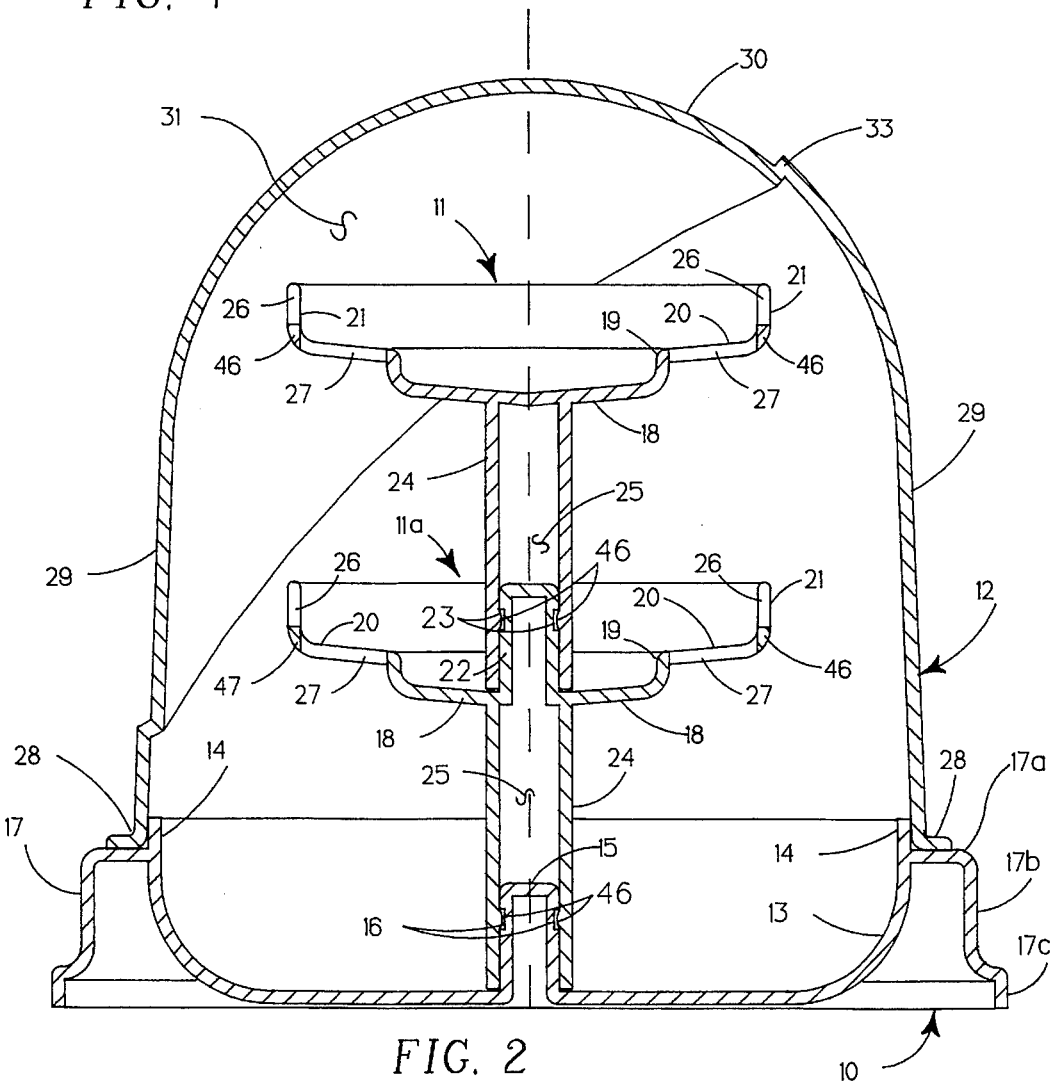
FIG. 2 is a medial, vertical cross-sectional view, through my container, with the cover in place thereon, to show the details of its construction.

The earrings of FIGS. 3D and 3E normally are positioned with their shaft structure in one of the channels 26, though the adhesive earring of FIG. 3E may be adhered to the rim or tray structures if desired to prevent drying and oxidation of the adhesive coating.

When it is desired to view various jewelry stored in the tray elements or about them, those elements may be rotated independently of the base and any other tray elements, so that particular stored items may be brought into view in any position about the base structure.

The cover 12 may be formed of clear or opaque rigid material to allow viewing of the contents through the cover or to conceal those contents as desired by an individual user.

It should be particularly noted that in storing earrings in my container as described, the ornamental portions of the earrings may be exposed about the periphery of the various trays carrying them, so that they may be readily observed. It is also to be noted that removable fastening portions of earrings will be carried in fastenable engagement on the earring structure and that pairs of earrings may be associated in adjacency with each other to allow ready identification of the members of a pair.

It is further to be noted that various of the earrings described may be fastened and supported in the tray structure otherwise than as described. For instance the hook type earring may be supported in one of the channels 27 with the earring depending therefrom. The clasp type earring may be taken apart and positioned in the channels 20 and the clasp thereafter re-installed thereon to allow the ornament to extend either upwardly or downwardly from a tray. The clamp type earring of FIG. 3B may be clamped about the peripheral rim of the tray without using the slot structure at all.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A covered container for earrings and small jewelry, comprising in combination:

a base defining a container dish with upstanding rim supported by an annular peripheral skirt structurally communicating with the upstanding rim of the container dish and depending therefrom to define a lower rim for support on an underlying supporting surface, said container dish having in its medial portion an upstanding cylindrical fastening column;

a storage tray having a medial tray dish with a peripheral upstanding rim having an upper edge, said upstanding rim structurally supporting a radially outwardly extending annular support shelf having an upstanding rim thereabout, said annular support shelf defining a plurality of spaced radially extending channels, said upstanding rim of the annular support shelf defining a plurality of vertical channels extending from the upper edge of the rim into spaced adjacency with the annular support shelf and aligned with each channel defined in the support shelf, and said storage tray having a depending tubular support column defining a cylindrical channel for rotatable support on the fastening column of the container dish; and a cover having a lower rim adapted to fit about the upstanding rim of the container dish and upon the peripheral skirt of the base, said cover having a medial body portion and hemispherical top portion to define an internal chamber to contain the storage tray when the cover is positioned on the base.

2. The container of claim 1 having at least one intermediate storage tray with a medial dish having a medial portion and supporting a peripheral upstanding rim supporting a radially outwardly extending annular support shelf with a perpendicular upstanding rim thereabout, said rim having an upper edge, said annular support shelf defining a plurality of spaced radially extending channels, said perpendicular upstanding rim of the annular support shelf defining a plurality of vertical channels extending from the upper edge of the rim into spaced adjacency with the annular support shelf and aligned with each channel defined in the support shelf, and said intermediate storage tray having a depending tubular support column with a cylindrical channel for rotatable support on the fastening column of a lower fastening column and an upstanding fastening column carried in the medial portion of the medial dish of the intermediate storage tray.

3. The container of claim 1 wherein the top and body portions of the cover further define an indented panel having a thicker portion above a peripheral area between the indented panel and cover to provide additional strength and rigidity for the cover.

* * * * *